US009167861B2

(12) United States Patent
Gafforio et al.

(10) Patent No.: US 9,167,861 B2
(45) Date of Patent: Oct. 27, 2015

(54) SAFETY HELMET WITH ANTI-DAZZLE VISOR

(75) Inventors: Luca Gafforio, Comun Nuovo (IT); Gabriele Tomasoni, Bariano (IT); Alberto Salvetti, Bergamo (IT)

(73) Assignee: NOLANGROUP S.P.A., Brembate di Sopra (BG) (IT)

( * ) Notice: Subject to any disclaimer, the term of this patent is extended or adjusted under 35 U.S.C. 154(b) by 610 days.

(21) Appl. No.: 13/542,157

(22) Filed: Jul. 5, 2012

(65) Prior Publication Data

US 2013/0031699 A1 Feb. 7, 2013

(30) Foreign Application Priority Data

Aug. 3, 2011 (EP) ..... 11006372

(51) Int. Cl.
*A42B 3/22* (2006.01)

(52) U.S. Cl.
CPC ..... *A42B 3/226* (2013.01)

(58) Field of Classification Search
CPC ..... A42B 3/18; A42B 3/225
USPC ..... 2/6.3, 6.4, 6.5, 8.4, 410, 421, 422, 424, 2/425
See application file for complete search history.

(56) References Cited

U.S. PATENT DOCUMENTS 3,495,273 A * 2/1970 Aileo ..... 2/6.4
3,721,994 A * 3/1973 DeSimone et al. ..... 2/410
3,783,452 A * 1/1974 Benson et al. ..... 2/6.4
3,792,702 A * 2/1974 Delest ..... 128/207.11
3,990,757 A * 11/1976 Gill ..... 439/37
4,862,878 A * 9/1989 Davison et al. ..... 602/20
5,752,280 A * 5/1998 Hill ..... 2/453
6,134,719 A * 10/2000 Kuo ..... 2/424
6,226,803 B1 5/2001 Tanaka
7,376,981 B2 * 5/2008 Shida ..... 2/424

(Continued)

FOREIGN PATENT DOCUMENTS

ES 1068414 * 7/2008
WO 2008/034486 A1 3/2008

(Continued)

OTHER PUBLICATIONS

Machine translation of WO 201010066278 A1from Italian into English language on Jan. 22, 2015 provided by EPO, pp. 1-10.*
Machine translation ES 1068414 from Spanish into English language on Jan. 22, 2015 provided by EPO, pp. 1-9.*

*Primary Examiner* — Clinton T Ostrup
*Assistant Examiner* — Anne Kozak
(74) *Attorney, Agent, or Firm* — Lucas & Mercanti, LLP

(57) ABSTRACT

Disclosed is a safety helmet having an outer shell, having a front opening, coupled with an inner shell made of shock absorption material, an anti-dazzle visor constrained to the outer shell and movable between a position of engagement and a position of disengagement with the front opening, and an operating portion of the anti-dazzle visor, integral with this latter, and controlled, through a motion transmission cable, by a control slider coupled to a related guide fastened to the outer shell. The control slider is translatable manually between an inactive position and an active position in which the anti-dazzle visor is arranged in a position of engagement. Advantageously, the motion transmission cable has one end integral with the outer she and the other end integral with the control slider, and engages with a drive constrained to the operating portion of the anti-dazzle visor, for movement of this latter.

13 Claims, 5 Drawing Sheets

(56) References Cited

U.S. PATENT DOCUMENTS

| | | | | |
|---|---|---|---|---|
| 8,051,500 | B2 * | 11/2011 | Lee | 2/424 |
| 8,458,822 | B2 * | 6/2013 | Lee | 2/424 |
| 8,572,767 | B2 * | 11/2013 | Bryant et al. | 2/425 |
| 2005/0015861 | A1 * | 1/2005 | Gafforio et al. | 2/424 |
| 2008/0028501 | A1 | 2/2008 | Schimpf | |
| 2008/0196148 | A1 * | 8/2008 | Morin | 2/421 |
| 2012/0222194 | A1 * | 9/2012 | Martin | 2/209.13 |
| 2012/0284905 | A1 * | 11/2012 | Kim | 2/424 |

FOREIGN PATENT DOCUMENTS

| | | | |
|---|---|---|---|
| WO | WO 2008034486 | A1 * | 3/2008 |
| WO | WO 2008035927 | A1 * | 3/2008 |
| WO | 2010/000899 | A1 | 1/2010 |
| WO | 2010/066278 | A1 | 6/2010 |
| WO | WO 2010066278 | A1 * | 6/2010 |

* cited by examiner

SAFETY HELMET WITH ANTI-DAZZLE VISOR

CROSS-REFERENCE TO RELATED APPLICATION

This Application claims the benefit of priority from European Patent Application No. 11006372.4, filed Aug. 3, 2011, the contents of which are incorporated herein by reference.

FIELD OF THE INVENTION

The present invention relates to a safety helmet, in particular for motorcyclists or for users of other means of transport, of the type comprising an outer shell made of substantially rigid material, such as polycarbonate, and provided with a front opening, an inner shell made of shock absorption material, such as expanded polystyrene, an internal cap for the user's comfort, generally made of foam rubber covered in fabric, and at least one anti-dazzle visor which reversibly engages the aforesaid front opening of the helmet.

BACKGROUND OF THE INVENTION

It is known in the art to provide safety helmets for users of vehicles such as motorcycles, or snowmobiles, with an anti-dazzle visor, usually burnished or in any case produced in such a manner as to filter external light, which is pivoted, or constrained, to the outer shell and which, due to an appropriate operating mechanism, is movable between a position of engagement of the front opening of the helmet, i.e. to protect the user's sight, and a position of disengagement from the opening.

More in particular, it is known to produce a safety helmet comprising an outer shell made of rigid synthetic material, coupled integral to a complementary inner shell made of a shock absorbing material, usually an expanded material, in turn associated with a cap for the user's comfort, which is shaped in such a manner to have a front opening which allows the user to see and a lower opening to allow the helmet to be put on.

As it is known, in some safety helmets, known as "open face" helmets, the two openings mentioned above are connected to each other without interruption, while in other helmets they are separated from each other by a specific portion of the outer shell, provided with a corresponding shock absorbing layer, arranged in the user's chin area, and consequently called "chin guard". In this latter case, production of the chin guard secured integral with the remaining part of the outer shell gives produces helmets which are known as "full face", while the production of a chin guard that is pivoted, or in any case constrained with at least a degree of freedom, to the outer shell, and which can therefore usually be lifted relative to this latter, defines helmets known as "flip-up full face".

In any case, regardless of the type of safety helmet considered, it is known to constrain to the outer shell, or optionally to extensions of the chin guard, when this is of the type that can be flipped up, a visor for protection of the user's face which reversibly covers the aforesaid front opening, and, in some cases, it is known to constrain to the outer shell an antidazzle visor, intended to engage at least part of the user's field of vision.

The anti-dazzle visor is usually constrained to the outer shell by means of an operating mechanism which allows the user, through a specific manual control, to move the visor in relation to the outer shell to engage or disengage the front opening of the helmet with the antidazzle visor.

In this regard, there are known different operating mechanisms of the anti-dazzle visor which allow the user to switch, rapidly and easily, from the aforesaid position of engagement of the anti-dazzle visor, usually coinciding with a lowered position relative to the outer shell, to the position of disengagement, usually coinciding with a raised position relative to the outer shell, and vice versa.

It is in fact essential for the person wearing the helmet to be able during travel to move the anti-dazzle visor, rapidly and with simple manual movements, from its position covering the user's field of vision, i.e. of engagement with the front opening of the helmet, to its position out of the user's field of vision, i.e. of disengagement from the front opening, when there are sudden changes in environmental light conditions, for example when entering and exiting a tunnel.

It must be noted that, above all when requiring to change from the position of engagement of the anti-dazzle visor with the front opening of the helmet to the position of disengagement of the anti-dazzle visor, or vice versa, the rapidity with which this change takes place is particularly critical.

It is also essential for the anti-dazzle visor, once arranged in the most suitable position by the user, to remain firmly in this position and not to move accidentally, for example due to vibrations or slight knocks to which the safety helmet is subjected, to the opposite position.

This requirement is particularly important in the case in which the user utilizes the safety helmet provided with the anti-dazzle visor to drive a vehicle at night or to drive a vehicle in conditions of poor environmental light, or in cases in which the anti-dazzle visor is arranged by the user in the raised position of disengagement from the front opening of the helmet. In fact, in these cases accidental lowering, due to vibrations or knocks, of the anti-dazzle visor to the position of engagement with the front opening of the helmet could cause effective problems for the user, while driving the vehicle.

The operating mechanism of the anti-dazzle visor is therefore required to ensure, even when there are vibrations and slight knocks, that it firmly maintains at least the raised position of the anti-dazzle visor, after it has been arranged in this position by the user.

Among the operating mechanisms of the anti-dazzle visor of known safety helmets, those mechanisms that provide for the use of cables for transmitting motion from a control slider, which can be operated manually by the user, to the anti-dazzle visor, are particularly effective and structurally simple.

The international patent application WO 2006/037294 A1, by SCHUBERTH ENGINEERING AG, describes an operating mechanism for an anti-dazzle visor comprising two Bowden cables, i.e. cables capable of transmitting pushing and pulling forces and movements, which have one end thereof connected to at least one control slider, sliding inside a guide integral with the outer shell of the helmet, and the other end thereof connected respectively to lateral operating portions of the anti-dazzle visor. Operation of the control slider, by the user, causes, due to the Bowden cables, transmission of motion from the slider to the anti-dazzle visor, which is thus caused to move from a position covering the field of vision, corresponding to a lowered position, to the position out of the field of vision, corresponding to a raised position, and vice versa.

Although structurally simple., this operating mechanism for the anti-dazzle visor on the one hand proves to be relatively ineffective, given that the speed with which the anti-dazzle visor passes from its position of engagement to its position of disengagement is left to the manual rapidity of the user, and on the other hand the force required by the user to move the control slider, given the presence of the Bowden cables, is substantially equivalent to the force required to raise or lower the anti-dazzle visor, and can therefore represent a possible obstacle to rapid operation of the visor.

The international patent application WO 2010/066278 A1 by LAZER S. A., relates to an operating mechanism to raise or lower an anti-dazzle visor of a safety helmet which comprises a cable, of the flexible or Bowden type, extending between a control slider of the visor, in turn slidable inside a related guide integral with the outer shell of the helmet, and a slider., constrained to two arms of two respective levers, which are in turn integral with lateral end portions of the aforesaid anti-dazzle visor, to cause raising or lowering thereof relative to the outer shell and to the related front opening.

Manual movement of the control slider inside its guide causes, through the motion transmission cable and the kinematic mechanism composed of the slider and of the two levers, movement of the anti-dazzle visor from its lowered position, i.e. covering the user's field of vision, to its raised position, i.e. out of the field of vision, and vice versa.

Although this operating mechanism was designed to allow the user to apply relatively low forces in order to operate the anti-dazzle visor, due to the presence of the two levers employed, it nonetheless has a certain degree of structural complexity and is also cumbersome and difficult to assemble.

Moreover, although the operating mechanism of the anti-dazzle visor described in WO 2010/066278 A1 allows the anti-dazzle visor to be operated by exerting a limited force on the related control slider, it is not provided with specific technical means for rapidly raising this latter in the case of need and does not seem to have any mechanism that ensures the anti-dazzle visor remains stably in its raised position, of disengagement from the front opening of the helmet.

Although the German utility model DE 8534132 U, by WITZMANN does not refer explicitly to a helmet provided with an anti-dazzle visor, it describes a mechanism for raising and lowering the protective visor relative to the front opening of the shell, which includes the use of two flexible motion transmission cables, coupled functionally to a control slider and, respectively, at the lower lateral ends of the visor that act as operating portions of this latter. The helmet also comprises elastic return means, which, interposed functionally between the outer shed and the visor, are structured to push the visor into its raised position, i.e. of disengagement from the front opening of the helmet.

The control slider, which engages slidingly inside a stepped guide adapted to provide a plurality of stable retaining positions for the slider, can be operated by the user in order to lower the visor in opposition to the action of said elastic return means.

Although this visor operating mechanism ensures considerably rapid raising of the visor, it suffers from the same drawbacks already set forth in relation to the international patent application WO 2006/037294 A1, as the force to apply to the slider, given the direct transmission of forces from the slider to the visor, must be equivalent to the force required to raise or lower the visor.

SUMMARY OF THE INVENTION

An object of the present invention is therefore to provide a safety helmet of the type comprising an anti-dazzle visor provided with an operating mechanism of this latter which does not have the drawbacks of prior art set forth above.

The object of the present invention is therefore to produce a safety helmet provided with an anti-dazzle visor movable between at least one position of engagement with the front opening of the related outer shell and one position of disengagement therefrom, and comprising a cable for transmitting motion from a control slider, sliding in a guide integral with the outer she of the helmet, and an operating portion of the anti-dazzle visor, which is structurally simple, and at the same time allows the anti-dazzle visor to be moved by exerting a limited force on the control slider.

A further object of the present invention is to provide a safety helmet of the type indicated above which, in addition to the characteristics mentioned above, is also considerably safe to use and which, in particular, prevents the anti-dazzle visor from being accidentally moved from its position of disengagement from the front opening of the helmet, after being placed in that position, by the user, due to vibrations, even slight knocks, or other accidental causes.

These and other objects are achieved by the safety helmet according to the first independent claim and the subsequent dependent claims.

The safety helmet according to the present invention comprises an outer shell, provided with a front opening and coupled to a related inner shell made of shock absorbent material, and at least one anti-dazzle visor constrained to the outer shell and movable between at least one position of engagement with the front opening and at least one position of disengagement from this latter, an operating portion of the anti-dazzle visor, integral with this latter, and controlled, through at least one motion transmission cable, by a control slider coupled slidingly to a related guide fastened to the outer shell, and wherein the control slider can be translated manually between an inactive position, in which the anti-dazzle visor is arranged in its position of disengagement, and an active position in which the anti-dazzle visor is arranged in its position of engagement. Advantageously, the motion transmission cable has one end integral, directly or indirectly, with the outer shell and the other end integral with the control slider, and engages with at least one drive (transmission) constrained to the operating portion of the anti-dazzle visor in such a manner as to move integrally with this latter, to move the operating portion of the anti-dazzle visor.

As will be understood by those skilled in the art, the use of a drive, preferably constituted by a sheave or by a pulley, to which the motion transmission cable is coupled, surrounding it, allows a decrease in the force to apply to the control slider to move the anti-dazzle visor from its position of disengagement with the front opening of the outer shell, to a position of engagement with this latter.

It must be noted that the term "drive" is intended as any structural element destined to engage with the aforesaid operating cable to transmit any motion to which the cable is subjected, from the cable to the operating portion with which the drive is integral. This drive can therefore be a pivot integral with the operating portion, or a sheave or moving pulley, constrained to the operating portion of the anti-dazzle visor, etc.

In fact, it is useful to remember that, in the case of a moving sheave, pulley, bearing a given load (Le. in this case the weight of the anti-dazzle visor, if need be with the addition of the load exerted by a return spring which, as will be seen below, can preferably be used) and surrounded by a rope, or cable for the transmission of motion, constrained to one end thereof, the kinematic equilibrium of the system, in ideal conditions, requires that the force applied at the free end of the rope is in equilibrium with the load of the sheave, or pulley, when this latter is equal to double the force applied to said free end of the rope.

Therefore, to simplify and as is known in mechanics, this is a kinematic mechanism comparable to a mechanical advantage.

According to a preferred aspect of the present invention, the safety helmet is also provided with elastic return means acting directly, or indirectly, on the anti-dazzle visor to push it toward the aforesaid position of disengagement.

As will be clear to those skilled in the art, the use of these elastic return means allows the anti-dazzle visor to be maintained effectively in its raised position, i.e. of disengagement from the front opening of the helmet, once that position has been established by the user, also in the event of vibrations of accidental knocks to which the safety helmet can be subjected.

Moreover, the presence of the aforesaid elastic return means, preferably constituted by a spring constrained between the outer shell and the anti-dazzle visor, allows the anti-dazzle visor to be returned automatically to its position of disengagement from the front opening of the outer shell (i.e. out of the user's field of vision) when, as will be seen, the user intends to operate specific temporary retaining means of the control slider, releasing it, In fact, according to another aspect of the present invention, the safety helmet also comprises manually operated temporary retaining means of the control slider, which act on the control slider when this is arranged in its aforesaid active position, retaining it in this position.

In particular, in a preferred embodiment of the present invention, these temporary retaining means comprise a body, preferably constituted by a lever provided with a stop pawl, which moves between a locked position in engagement with this control slider, appropriately provided with at least one seat for temporary engagement with said stop pawl, and an unlocked position of disengagement from said control slider. This moving body is also thrust elastically toward its locked position, i.e. toward its position in which the stop pawl, if present, is engaged with the related seat made on the control slider.

It must be noted that, in another embodiment of the present invention, the control slider can comprise two or more seats for said stop pawl of the elastic lever which preferably constitutes said temporary retaining means.

BRIEF DESCRIPTION OF THE DRAWINGS

Some embodiments of the present invention will now be described, purely by way of non-limiting example, with reference to the accompanying figures, wherein.

DETAILED DESCRIPTION OF THE INVENTION

Figure 1:
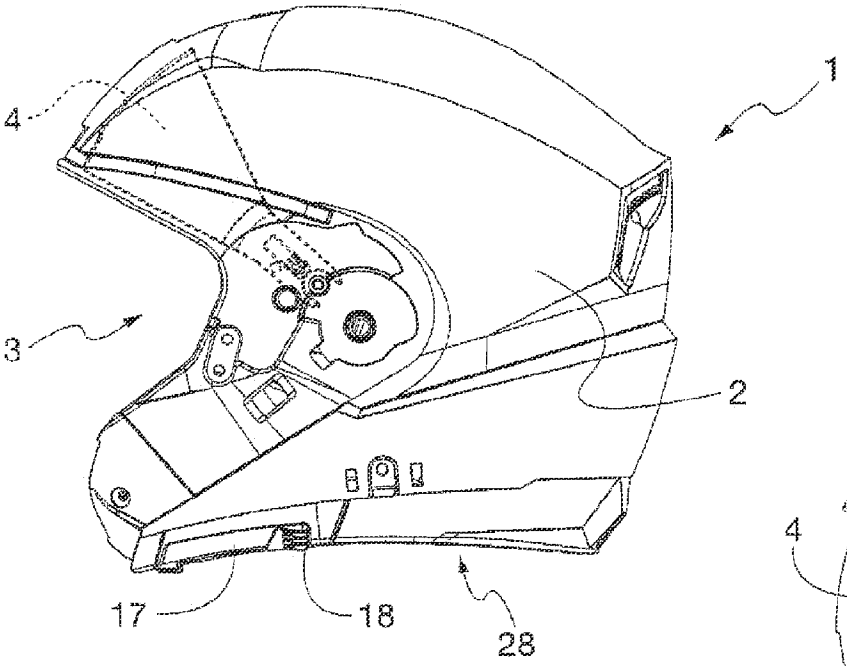
FIG. 1 is a partial side view of a safety helmet according to a particular aspect of the present invention, with an anti-dazzle visor in a position of disengagement from the front opening of the outer shell.

With reference firstly to FIGS. 1 and 2, the safety helmet 1, according to a particular aspect of the present invention, comprises an outer she 2, usually made of polycarbonate, or also other thermoplastic resins, such as ABS or also with composite materials, provided with a lower opening 28 to allow the helmet 1 to be put on, and a front opening 3, through which the user's field of vision extends.

Figure 2A:
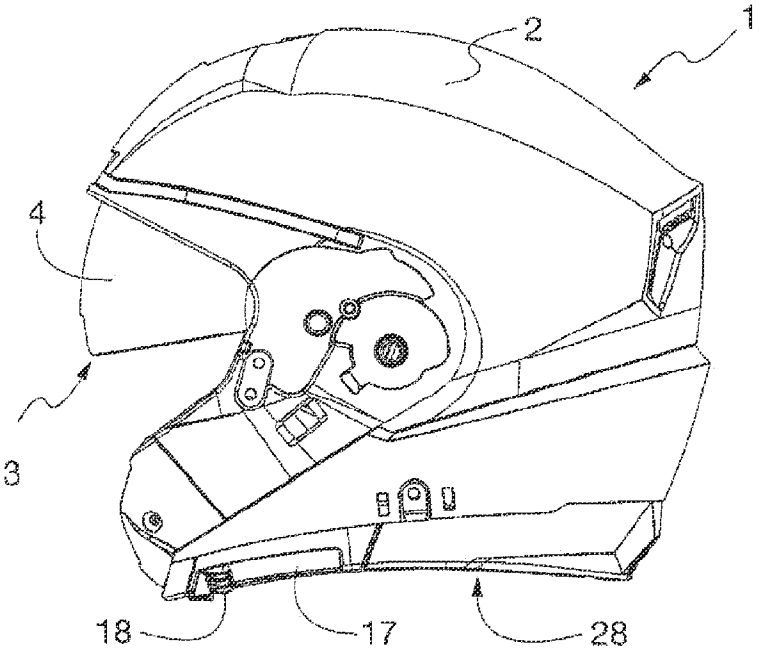
FIG. 2*a* is a partial side view of the safety helmet shown in FIG. 1, with the anti-dazzle visor arranged in a position of engagement with the front opening of the outer shell, i.e. at least partially covering the user's field of vision.
Figure 2B:
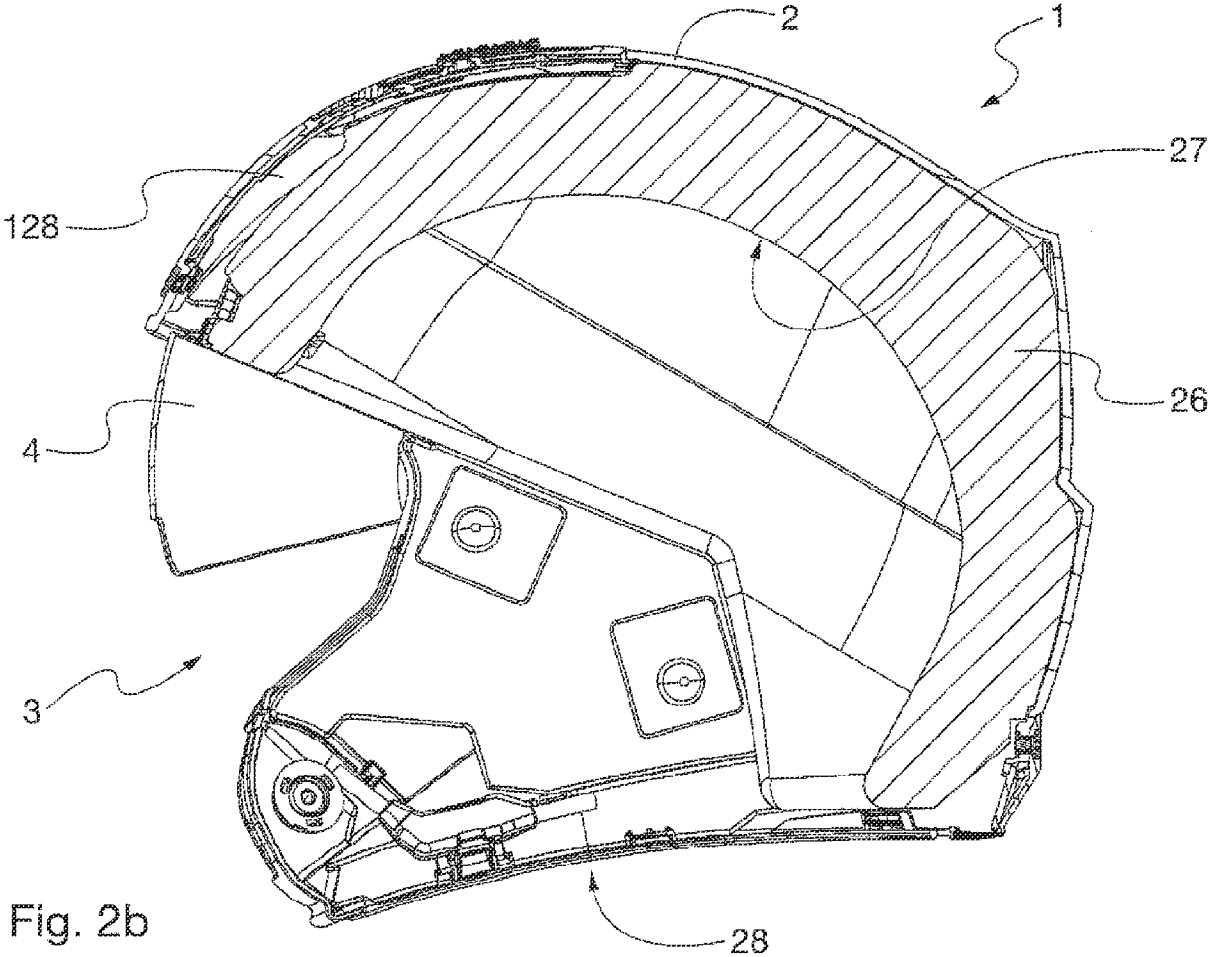
FIG. 2*b* is a sectional side view of the safety helmet of FIG. 1, shown in the same position illustrated in FIG. 2*a;*

As is particularly visible in FIG. 2*b*, the safety helmet 1 also comprises an inner shell 26, made of a material suitable to absorb any shocks, such as expanded polystyrene (EPS), and a cap which interfaces between the inner shell 26 and the user's head, not shown, destined to be fastened, usually in a removable manner, to the inner surface 27 of this inner shell 26. This interfacing cap, according to prior art, can be made of foam rubber covered with a specific fabric and has the purpose of improving the user's comfort when wearing the helmet.

It must be noted that the safety helmet 1 of FIGS. 1, 2*a*, 2*b*, used here to illustrate the invention claimed herein, is not provided with a "chin guard", i.e. the portion of the helmet destined to protect the user's chin, provided on full face or flip-up full face helmets. However, as will be clear to those skilled in the art, the present invention can equally be applied to helmets provided with a chin guard integral with the outer shell, to helmets with a flip-up chin guard, or also to helmets with a removable chin guard, without the need for any particular adaptation.

The safety helmet 1 illustrated here, according to prior art, can comprise a protective visor (not shown in the figures), substantially transparent, and destined to move between a position in which it covers the aforesaid front opening 3 of the safety helmet 1 and a position in which it is instead disengaged from this front opening 3. This protective visor can be pivoted, or in any case constrained with at least a degree of freedom, to the outer shell 2 of the safety helmet 1, at the sides of the related front opening 3, or, in other embodiments of the safety helmet 1 not illustrated here, can be pivoted, or in any case constrained, to a movable chin guard, with which the helmet 1 can optionally be provided.

The safety helmet 1 also comprises an anti-dazzle visor 4, burnished or in any case capable of filtering light, which, through a related operating mechanism, can be moved by the user from a position of engagement, albeit partial, with this front opening 3 (depicted in FIGS. 2*a* and 2*b*), corresponding to a position—lowered—covering this the user's field of view, to a position of disengagement from this opening 3 (depicted in FIG. 1), corresponding to a position—raised—out of the user's field of vision.

It must be observed that, in the particular embodiment of the safety helmet 1 illustrated in FIGS. 1, 2*a* and 2*b*, a seat 128, or recess, is preferably made between the outer she 2 and the inner shell 26, inside which the anti-dazzle visor 4 is housed when this latter is moved by the user in its position of disengagement from the front opening 3. According to this solution, the transparent protective visor (not shown) would be arranged on top of the anti-dazzle visor 4, i.e. in a more distant position from the front opening 3 of the outer shell 2 relative to the anti-dazzle visor 4, and preferably on the outside of the outer shell 2.

It must be noted that other embodiments of the safety helmet 1 described here which can provide for the use of an anti-dazzle visor 4 boated on the outside of the protective visor, or the absence of a recess for housing the anti-dazzle visor or which have no protective visor, are also intended as included in the scope of protection defined by the appended claims.

Figure 3:
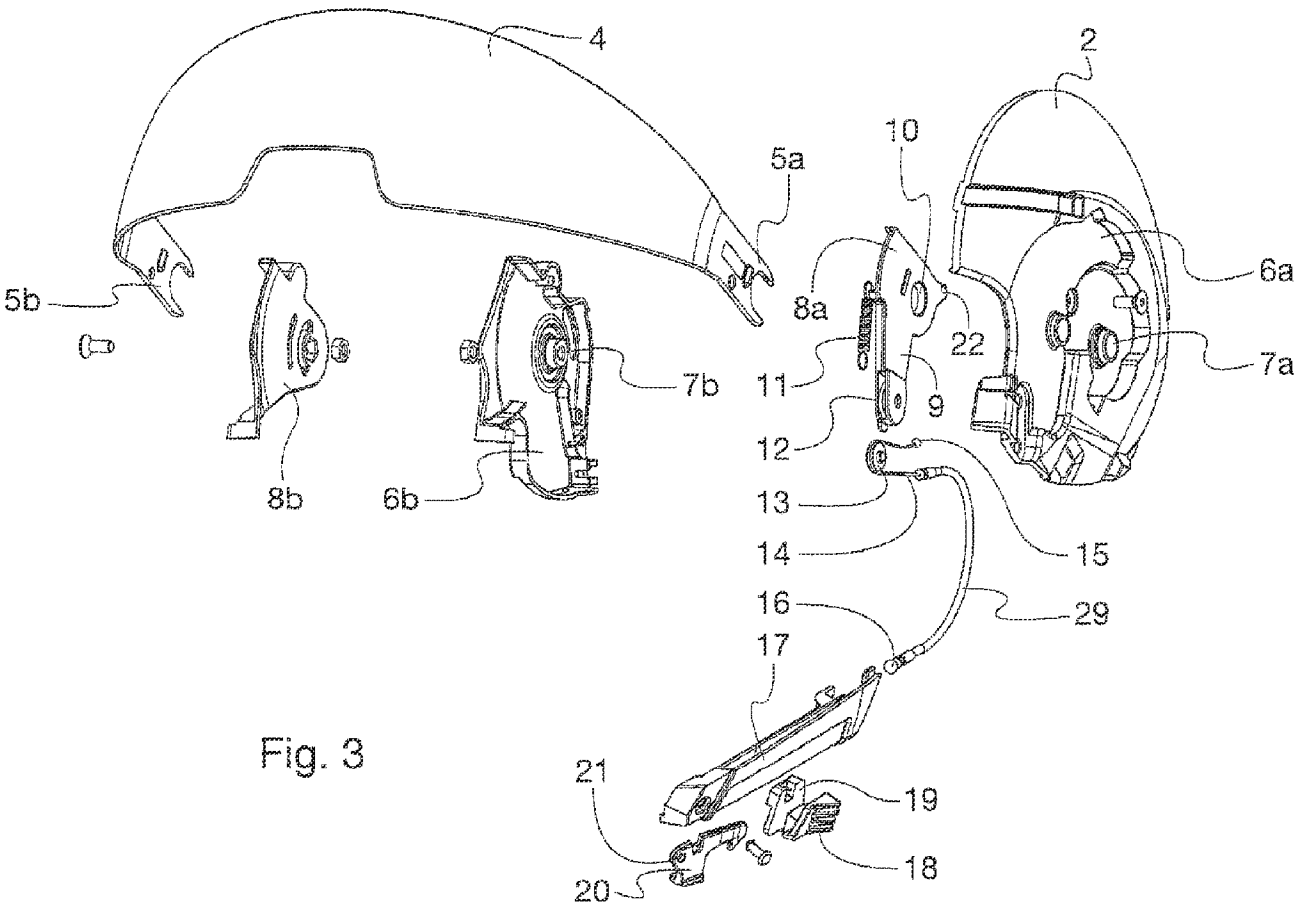
FIG. 3 is an exploded view of the anti-dazzle visor and of part of the related operating mechanism of the safety helmet of FIGS. 1 and 2.
Figure 5:
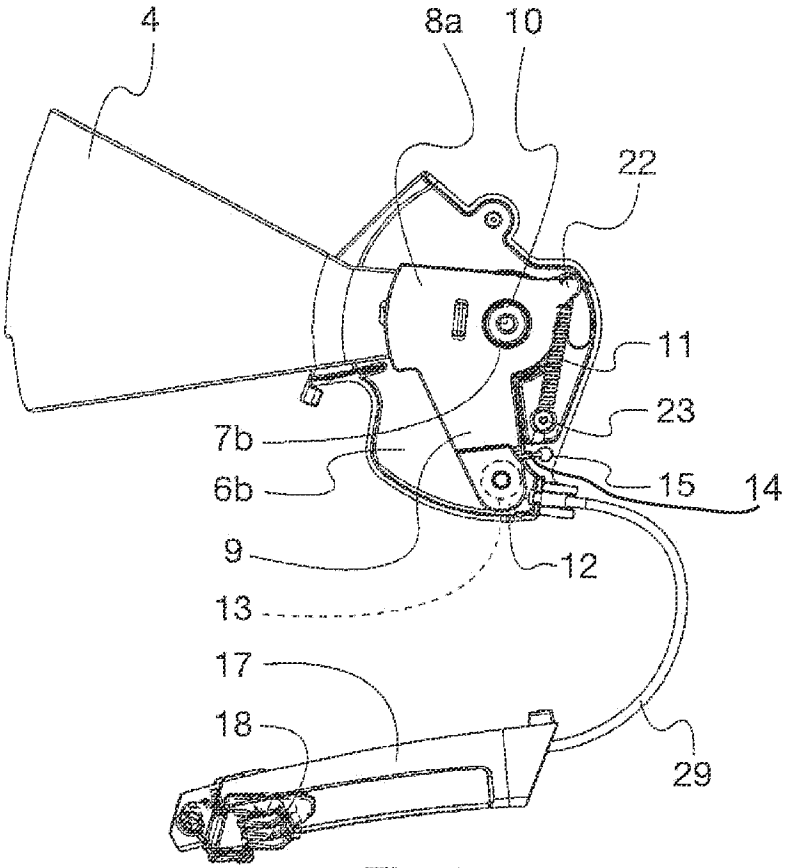
FIG. 5 is a schematic side view of the anti-dazzle visor and of part of the related operating mechanism of the safety helmet of FIG. 4, shown in its position of engagement with the front opening of the outer shell.
Figure 4:
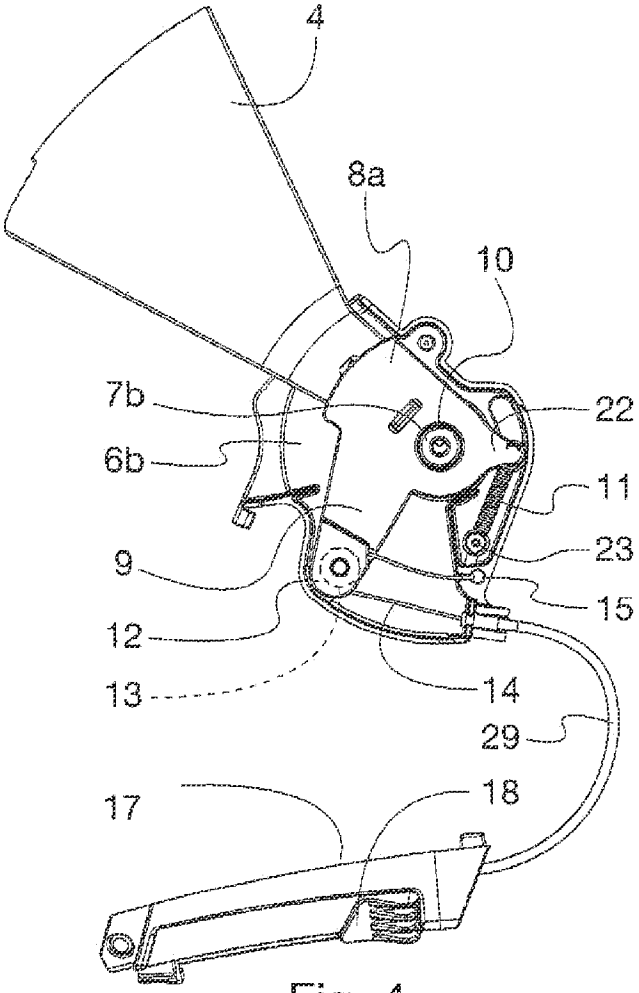
FIG. 4 is a schematic side view of the anti-dazzle visor and of part of the related operating mechanism of the safety helmet of FIGS. 1 and 2, shown in its position of disengagement from the front opening of the outer shell.

With reference now also to FIGS. 3, 4 and 5, the anti-dazzle visor 4 according to a particular aspect of the present invention, comprises a central region, capable of filtering light in a predefined manner, and two lateral ends 5*a*, 5*b*, U-shaped and destined to engage in an integral manner, for example by interlocking or through juxtaposing of parts, respectively with a first lateral operating support 8*a*, on one side of the outer she 2 relative to the front opening 3, and with a second lateral support 8*b*, on the other side of the outer she 2 relative to the front opening 3.

Both the first lateral support 8*a* and the second lateral support 8*b* comprise a seat for engagement in rotation, about a related pivot, with interface jigs, fastened integrally to the outer shell 2, or made in one piece therewith, in such a manner that the anti-dazzle visor 4 is thus pivoted at its lateral ends 5*a*, 5*b*, through interposing of the first lateral support 8*a* and the second lateral support 8*b*, with the outer shell 2.

More in particular, the first lateral operating support 8*a*, integral with the lateral end 5*a* of the anti-dazzle visor 4, comprises a hole 10 destined to engage with a corresponding pivot 7*b*, projecting from a mounting bracket 6*b*, for example made of plastic material, destined to be fastened integrally to the outer shell 2 of the safety helmet 1. A shaped region 6*a* of the inner surface of the outer shell 2, is structured to couple with the bracket 6*b*, for example through screw or grub screw, and to thus retain the first lateral mounting support 8*a* in the correct position. In practice, the first lateral operating support 8*a* of the anti-dazzle visor 4 is retained, rotatingly to the outer shell 2, in a lateral position relative to the front opening 3 of the safety helmet 1, through the mounting bracket 6*b* which is screwed to this shaped region 6*a*, rotatingly constraining the first lateral operating support 8*a*, interposed between bracket 6*b* and shaped region 6*a*.

It must be noted that, in the particular embodiment of the safety helmet 1 illustrated here, the shaped region 6*a* also comprises a projecting seat 7*a* for pivoting of a protective visor (not shown), or of a flip-up chin guard, for the safety helmet 1.

With regard to the second lateral support 8*b*, this is simply pivoted, for example through a screw or a pin, to a related region, not shown, of the internal surface of the outer shell 2 of the safety helmet 1, opposite the shaped region 6*a* relative to the front opening 3, so as to avow rotation of the anti-dazzle visor 4 relative to the outer shell 2.

It must be observed that, although the constraint provided in the safety helmet 1 for the anti-dazzle visor 4 is a constraint of rotating type, through pivoting of the visor 4 to the outer shell 2, any other type of constraint, for example of the "shoe" type, with a slider sliding inside a related guide, can alternatively be provided to constrain the anti-dazzle visor 4 to the outer shell 2, provided that this constraint allows movement of the anti-dazzle visor 4 between its aforesaid positions of engagement with and disengagement from the front opening 3 of the outer shell 2.

The lateral operating support 8*a* of the anti-dazzle visor 4 which, being integral, constitutes an operating portion of this anti-dazzle visor 4, is structured, in the particular embodiment of the invention shown here, in the form of a lever with two arms 9, 22, geometrically opposite each other relative to the aforesaid hole 10 for pivoting of the lateral support 8*a*.

One of the two arms 9 of the lateral support 8*a*, the one which in the accompanying figures is facing the lower portion of the outer she 2, i.e. facing the lower opening 28 of the safety helmet 1, comprises a seat 12 which houses a drive 13, in the form of disk-shaped sheave with central rotation pivot, for a cable 14, theoretically inextensible, destined to transmit motion from a slider 18 to the arm 9 of the lateral operating support 8*a* of the anti-dazzle visor 4, and therefore to this latter.

It must be observed that, although an embodiment of the safety helmet 1 in which the arm 9 of the lateral operating support 8*a* is facing the lower opening 28 of this safety helmet 1 has been illustrated here, alternative embodiments of this latter, in which the arm 9 of the lateral support 8*a* is arranged toward the top part of the outer shell 2, i.e. in opposite position to the one represented here, are also possible, without departing from the scope of protection requested herein for the present invention.

The cable 14, preferably constituted by flexible steel strands surrounded by a protective sheath 29 made of plastic material, comprises a first end 15 fastened to the outer she 2 through the bracket 6*b*, or an any case fastened integrally to this outer shell 2, and a second end 16, fastened to a slider 18, which can be manually operated by the user, which slides along a linear guide, not necessarily rectilinear, 17, also integral with the outer shell 2.

The protective sheath 29 is also constrained stably, at its ends (sheath-end), respectively to the bracket 6*b* and to the guide 17, in such a manner as to maintain unchanged its arrangement inside the safety helmet 1 and in this manner allow the cable 14 to run along a predetermined path.

As can be seen in FIGS. 1, 2*a* and 2*b*, this guide preferably curvilinear, is arranged integrally on a lower lateral edge of the outer shell 2, at the side of the opening of the safety helmet 1 for the user's head, n order to facilitate access to the slider 18 by the user.

The cable 14 also surrounds the sheave 13, being configured in a "U" around it, in such a manner that sliding of the slider 18 along the guide 17, at least in one direction, causes movement of the sheave 13 and therefore, given the pivoting constraint of this latter to the support 8*a*, of the anti-dazzle visor 4.

It must be noted that, although a cable 14 made of flexible metal material has been described here, it would be equally possible to use any other type of cable, or rope, capable of transmitting motion, at least in one direction of sliding of the slider 18, from the slider 18 to the sheave 13, or to another equivalent type of drive, and therefore to the lateral operating support 8*a*, and to the anti-dazzle visor 4. The number of motion transmission cables can also be varied according to requirements.

Alternatively, the flexible cable 14 can be replaced by one or more Bowden cables, capable of transmitting motion from the slider 18 to one more drives, in both directions of sliding of the slider 18 along the related linear guide 17. However, this case the Bowden cable or cables must be constrained for example, to at least two drives, which move integrally with the lateral operating support 8*a*, to be able to transmit the motion coming from the slider 18 in both directions.

The slider 18 and the related guide 17, in particular, are structured in such a manner that the slider 18 can assume along the guide 17 a first active position, in which the anti-dazzle visor 4, through the kinematic mechanism constituted by the cable 14, by the sheave 13 and by the lateral support 8*a*, is arranged in its position of engagement with the front opening 3 of the safety helmet 1, and a second inactive position corresponding to the aforesaid position of disengagement of the anti-dazzle visor 4 from the front opening 3.

As can be seen in the figures, the inactive position of the control slider 18 coincides, in the embodiment described here, with the rear limit stop of the linear guide 17, while its active position substantially coincides with the front limit stop of the guide 17.

According to a preferred aspect of the present invention, in the case in which the cable 14 is a flexible metal cable capable of transmitting the motion imparted to the slider 18 only in its direction of pulling, and therefore in the helmet 1 illustrated here only when the slider 18 is moved toward its active position, the inactive position of the control slider 18 is obtained through the presence of elastic return means 11 for the anti-dazzle visor 4, which act directly, or indirectly, on this latter, to return it to its position of disengagement and, in this way, to return the control slider 18 to its aforesaid inactive position.

In this way, the other arm 22 of the lateral support 8*a* of the anti-dazzle visor 4, in the particular embodiment of the present invention shown here, is coupled to elastic return means 11 functionally interposed between the arm 22 and the outer shell 2, the ends of which are respectively pivoted to the arm 22 of the lateral support 8*a* and, through a pin 23 (see FIGS. 4 and 5), to the bracket 6*b*, in turn fastened integrally to the outer shell 2. In a specific embodiment, the elastic return means 11 is a cylindrical coil spring.

The elastic return means 11, which is elongated from its initial resting configuration when the anti-dazzle visor 4 is arranged in its lowered position of engagement with the front opening 3 of the helmet 1 (FIG. 5), and therefore when the slider 18 is in its active position, acts by returning to its resting position, returning the anti-dazzle visor 4 to its raised position of disengagement (FIG. 4), and therefore returning the slider 18, through the lateral support 8*a*, the sheave 13 and the cable 14, to its inactive position.

In practice, movement of the slider 18 along the guide 17 in the pulling direction of the cable 14 by the slider 18 (i.e. from right to left in FIG. 3), through the constraint with the end 16 of the cable 14 and the fact that this latter is integral with the outer shell 2 by means of its other end 15, albeit opposed by the elastic return means 11, causes movement of the sheave 13 and therefore of the anti-dazzle visor 4 from a raised position to a lowered position, until the slider 18 reaches its limit stop position along the guide 17. In this position of the slider 18, defined here as active position, the anti-dazzle visor 4 is in its lowered position, of engagement with the front opening 3 of the helmet 1.

Movement of the slider 18 along the guide 17 in the opposite direction to the pulling direction of the cable 14 by the slider 18 (i.e. in the direction that runs from left to right in FIG. 3) is instead caused by the elastic return means 11, which has a pulling action on the cable 14 by means of the sheave 13, returning the slider 18 toward its aforesaid inactive position which, as stated, corresponds to the position of disengagement of the anti-dazzle visor 4 from the front opening 3 of the helmet 1.

It must be observed that, although the use of a spring, or of other elastic return means, 11 interposed between the arm 22 of the lateral support 8*a* of the anti-dazzle visor 4 and the pin 23 of the related bracket 6*b*, integral with the outer shell 2, has been described here, any other arrangement of these elastic means 11 which allows the slider 18 to be returned to the aforesaid inactive position, and consequently to its raised position of disengagement from the front opening 3 of the safety helmet 1, can alternatively be used.

FIGS. 4 and 5 respectively illustrate, as already mentioned, the arrangement of the slider 18 along the guide 17, the related configuration of the cable 14, and the corresponding arrangement of the drive 13 (shown as a sheave), of the lateral support 8*a*, and of the elastic return means 11, when the anti-dazzle visor 4 is in lowered position, of engagement with said front opening 3.

Figure 6B:
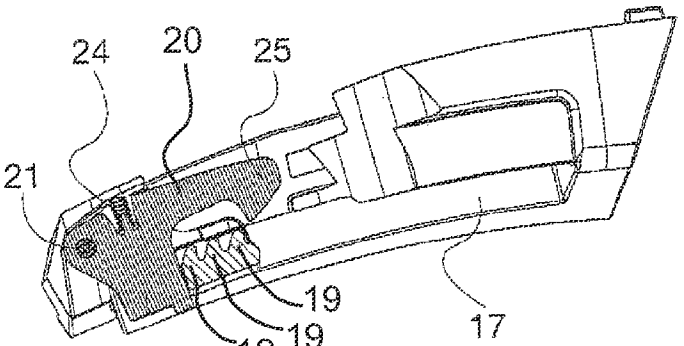
FIGS. 6*a*-6*c* illustrate, in a partial side view, the control slider and the related temporary retaining means, for operation of the anti-dazzle visor, according to a particular aspect of the present invention, shown in different operating positions.
Figure 6A:
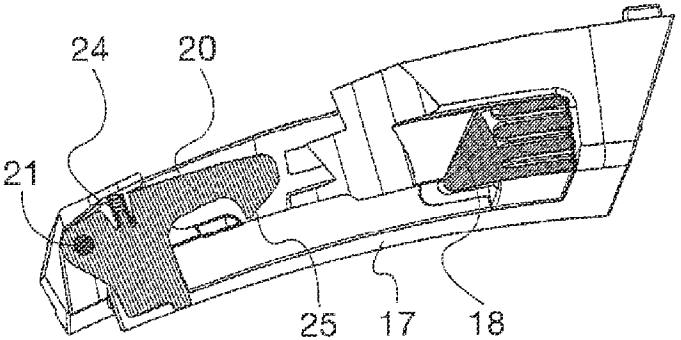
Figure 6C:
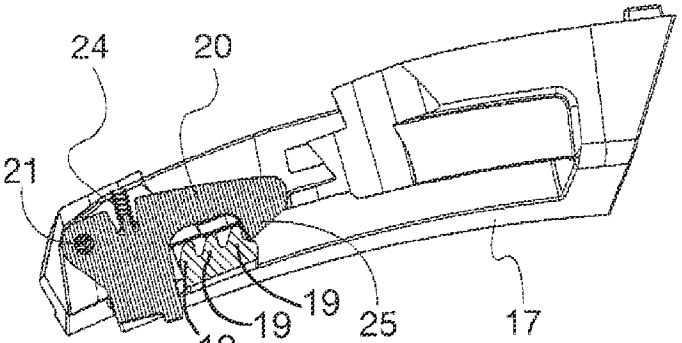

With reference now to FIGS. 6*a*-6*c*, the safety helmet 1, according to a particular aspect of the present invention, also comprises manually operated temporary retaining means 20, 21, 24, 25 of the slider 18, which act on this slider 18 when it is in its active position, corresponding to the lowered position, of engagement with the front opening 3 of the helmet 1, of the anti-dazzle visor 4.

These temporary retaining means, in the embodiment of the present invention illustrated in FIGS. 6*a*-6*c*, comprise a lever 20, pivoted through a pivot 21 at a limit stop end of the linear guide 17, and provided with a stop pawl 25, shaped to engage with one of the seats 19 made on the slider 18, to lock this latter in retention.

This lever 20 is also subject to the thrust force of a spring 24, interposed between the lever 20 and the guide 17, or in any case between the lever 20 and the outer shell 2, which is intended to push the stop pawl 25 toward the locked position in engagement with one of the seats 19.

The lever 20 is also provided with an arm, opposite the stop paw 25 relative to the pivot 21, susceptible to be operated manually by the user and structured in such a manner that its thrust, in opposition to the force exerted by the spring 24, allows temporary disengagement of the stop pawl 25 from the seat 19 and consequent release of the slider 18.

As can be seen in particular in FIG. 6*c*, which shows a lateral section of the control slider 18, the slider 18 comprises, according to a particular aspect of the present invention, a toothed portion which defines the seats 19, inside which the aforesaid stop pawl 25 can alternatively engage.

The presence of the seats 19 in the control slider 18, spaced apart from one another along the direction according to which the linear guide 17 extends, and therefore along the direction of movement of the slider 18, through the related engagement of the stop pawl 25 of the elastic lever 20 in one of these seats 19, allows the user to identify several positions of engagement of the anti-dazzle visor 4 with the front opening 3 of the helmet 1, in such a manner that the amount of downward movement of the anti-dazzle visor 4 varies as a function of the seat 19 selected for engagement with the stop pawl 25 and consequently in such a manner that covering of the field of vision by the anti-dazzle visor 4 is the most suitable for the user's characteristics.

Figure 7:
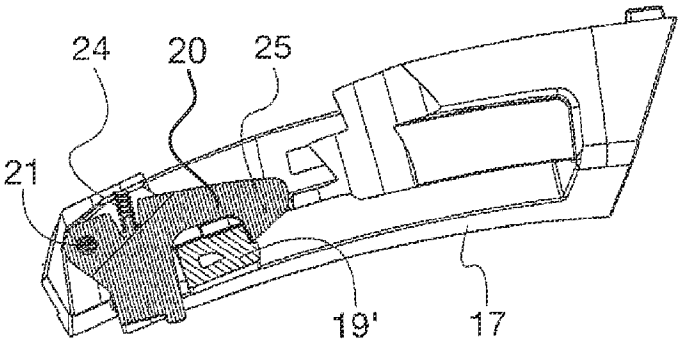
FIG. 7 shows, in a partial side view, the control slider and the related temporary retaining means, for operation of the anti-dazzle visor, in a different embodiment of the present invention.

However, in order to simplify production of the slider 18, according to an alternative embodiment of the present invention shown in FIG. 7, the slider 18 can comprise a single seat 19' for engagement with the stop pawl 25 of the lever 20.

Although a lever 20 provided with a stop pawl 25 for the slider 18 is described above, it must be noted that any other body capable of temporarily engaging in retention with the control slider 18 and thrust elastically in this locked position in engagement with this control slider 18, and capable of reaching, through a manual thrust, a position of release of the slider 18, can be used alternatively in place of the lever 20. The lever 20, the pivot 21, the spring 24, and the step pawl 25 collectively form a retaining means (hereafter referred to as retaining means 20, 21, 24, 25).

It must also be noted that, although the safety helmet 1 illustrated here provides for the use of the retaining means 20, 21, 24, 25 of the control slider 18 constituted by a moving body separated from the slider 18, any other means, also made on the slider 18, which is capable of maintaining this latter in a given required position, optionally overcoming the return force exerted by the elastic means 11, if present, can be used alternatively.

Moreover, in the case in which, in place of the elastic return means other means, not described here, are provided for manual return of the anti-dazzle visor 4 to its aforesaid position of disengagement, and therefore of the slider 18 to its aforesaid inactive position, for example through the use of a Bowden cable, or through a strut which connects the slider 18 to the lateral operating support 8*a*, the aforesaid temporary retaining means 20, 21, 24, 25 may not be necessary.

Operation of the safety helmet 1 described above, with reference by way of example to FIGS. 1 to 6*c*, is as follows.

Starting from the raised position of the anti-dazzle visor 4, i.e. of disengagement of this latter from the front opening 3 of the outer shell 2, depicted in FIGS. 1, 4, 6*a*, and wishing to protect the sight from a light source considered excessive, the user can manually operate the slider 18, which is located in its inactive position of lower limit stop along the guide 17, sliding this slider 18 toward its active position, placed substantially at the front limit stop of this guide 17.

The motion imparted to the slider 18 from its inactive position (to the right in the figures) toward its active position, i.e. toward the front limit stop of the linear guide 17, is transmitted to the anti-dazzle visor 4 through engagement of the sheave 13 with the cable 14 which, subjected to pulling by the slider 18 starting from its end 16, as can be seen from examining FIGS. 4 and 5, moves reducing the portion thereof arranged in a "U" around the sheave 13.

More in particular, translation of the slider 18 toward its active position, causing a reduction in the segment of the cable 14 arranged in a "U" around the sheave 13, causes movement of the sheave 13, and therefore of the arm 12 of the lateral operating support 8*a*, in rotation about the pivot 7*b* (clockwise in the figures), so as to lower the anti-dazzle visor 4—integral with the support 8*a*—in engagement with the front opening 3 of the outer shell 2.

This rotation of the lateral operating support 8*a*, caused by the movement of the slider 18, takes place opposing the return force of the spring 11, which, as seen above, is structured to act on the other arm 22 of the same lateral support 8*a*, extending beyond its initial resting position.

As has been already observed, the use of a sheave 13, or of another drive, surrounded by the cable 14, appropriately fastened to the outer shell 2 at the first end 15 and constrained at the second end 16 to the control slider 18, allows the anti-dazzle visor 4 to be moved with limited effort by the user, on the slider 18, relative to other prior art solutions.

After the control slider 18 has been moved in proximity of its active position, i.e. after reaching the required position of engagement of the anti-dazzle visor 4 with the front opening 3 of the helmet 1, the teeth of the slider 18 engage with the stop pawl 25 of the elastic lever 20, which is thrust constantly toward the locked position of the slider 18 by the related spring 24, It must be observed that appropriate inclination of the teeth of the slider 18 and of the stop pawl 25 ensures that when the slider 18 is in proximity of the stop pawl 25, this is temporarily raised by the inclined surface of the teeth of the slider 18, thereby causing rotation in one direction (counter-clockwise in the figures) of the lever 20 about the pivot 21, to oppose the action of the spring 24, until the stop pawl 25 engages with one of the seats 19, inside which this stop pawl 25 is thrust by the spring 24, which causes a rotation in the opposite direction (clockwise in the figures) of the lever 20 about the pivot 21.

In this position, after translation of the slider 18 inside the guide 17 by the user has ceased, the stop pawl 25 engages stably inside a related seat 19 of the slider 18, temporarily retaining, through the action of the spring 24, the slider 18 in its active position, corresponding to the required position of engagement of the anti-dazzle visor 4 with the front opening 3 of the helmet 1.

When the user wishes to raise the anti-dazzle visor 4, to its position of disengagement, for example due to a sudden change in environmental light conditions, then he/she can act on the projecting arm of the lever 20, opposite the stop pawl 25, overcoming the resistance of the spring 24 to cause a rotation (counter-clockwise in the figures) of the lever 20 about the pivot 21, so as to disengage the stop pawl 25 from the seat 19 in which it is housed.

At this point, the slider 18, no longer retained by the lever 20, is returned to its inactive position, corresponding to the rear limit stop of the guide 17, through the return action exerted by the spring 11 on the arm 22 of the first lateral operating support 8*a* of the anti-dazzle visor 4.

In fact, after the control slider 18 has been released from the stop pawl 25, the return spring 11 tends to be compressed, to return to its initial resting position, thus causing, through its constraint with the aforesaid arm 22, a rotation of the first lateral operating support 8*a* about the related pivot 7*b* (clockwise in the figures), which takes the anti-dazzle visor 4 to its initial position of disengagement from the front opening 3 of the outer shell 2.

This rotation, naturally also involving the arm 9 of the first lateral operating support 8*a*, causes corresponding and integral rotation, about the pivot 7*b*, of the sheave 13, which, with the cable 14 arranged in a "U" around it, in turn acts on the cable 14, causing a movement thereof which returns the slider 18 to its inactive position along the guide 17.

In this way, the initial conditions of the safety helmet 1 are rapidly restored and, as will be clear to those skilled in the art, the presence of the return spring 11 also allows the inactive position reached by the anti-dazzle visor 4 to be maintained stably, even in the presence of any vibrations or knocks acting on the safety helmet 1.

The invention claim is:

1. A safety helmet comprising:

an outer shell provided with a front opening, a related inner shell made of shock absorption material, at least one anti-dazzle visor connected to said outer shell and movable between at least one position of engagement with said front opening and at least one position of disengagement from said front opening, and an operating portion of said anti-dazzle visor, integral with said anti-dazzle visor, and controlled, through at least one motion transmission cable, by a control slider coupled slidingly to a related guide fastened to said outer shell, said control slider being translatable manually between an inactive position in which said anti-dazzle visor is arranged in said at least one position of disengagement and an active position in which said anti-dazzle visor is arranged in said at least one position of engagement, wherein said at least one motion transmission cable has one end integral with said outer shell and the other end integral with said control slider, and engages with at least one drive connected to said operating portion of said anti-dazzle visor, for movement of said anti-dazzle visor, said one end of said at least one motion transmission cable being fastened to said outer shell; wherein said at least one drive connected to said operating portion comprises a movable sheave, or a movable pulley, about which said at least one motion transmission cable is reeved, said movable sheave, or said movable pulley being movable with said operating portion relative to said shell.

2. The safety helmet according to claim 1, wherein said at least one motion transmission cable is arranged in a "U" around said movable sheave, or said movable pulley.

3. The safety helmet according to claim 1, further comprising a spring acting on said at least one anti-dazzle visor to thrust said at least one anti-dazzle visor toward said position of disengagement.

4. The safety helmet according to claim 3, wherein said spring is connected to said outer shell and to said anti-dazzle visor.

5. The safety helmet according to claim 3, wherein said operating portion comprises a lever with at least a first arm connected to said at least one drive, for movement of said anti-dazzle visor.

6. The safety helmet according to claims 5, wherein said lever comprises a second arm connected to said spring.

7. The safety helmet according to claim 1, further comprising a movable body movable between a locked position in engagement with said control slider and a released position in disengagement with said control slider, said movable body being thrust elastically toward said locked position.

8. The safety helmet according to claim 7, wherein said movable body is a lever provided with at least one stop pawl intended to engage with at least one seat on said control slider.

9. The safety helmet according to claim 8, wherein said control slider comprises two or more seats for said stop pawl.

10. The safety helmet according to claim 1, wherein said at least one cable is a flexible metal cable.

11. The safety helmet according to claim 1, further comprising at least one recess arranged, at least partly, between said outer shell and said inner shell to at least partially accommodate said anti-dazzle visor in said position of disengagement.

12. The safety helmet according to claim 1, further comprising a further protective visor, said anti-dazzle visor being arranged underneath said protective visor.

13. The safety helmet according to claim 1, wherein said guide for said control slider is a linear guide integral with the outer shell in correspondence to a portion of the outer shell placed laterally to said front opening.

* * * * *